US009881555B2

(12) United States Patent
Park et al.

(10) Patent No.: US 9,881,555 B2
(45) Date of Patent: Jan. 30, 2018

(54) ORGANIC LIGHT EMITTING DIODE DISPLAY DEVICE CAPABLE OF SENSING AND CORRECTING A PROGRESSIVE BRIGHT POINT DEFECT

(71) Applicant: LG DISPLAY CO., LTD., Seoul (KR)

(72) Inventors: Kwang-Mo Park, Uijeongbu-si (KR); Soo-Hong Choi, Paju-si (KR); Yoon-Ju Lee, Gangneung-si (KR); Kwang-Hun Jeon, Yeosu-si (KR)

(73) Assignee: LG DISPLAY CO., LTD., Seoul (KR)

( * ) Notice: Subject to any disclaimer, the term of this patent is extended or adjusted under 35 U.S.C. 154(b) by 168 days.

(21) Appl. No.: 14/922,911

(22) Filed: Oct. 26, 2015

(65) Prior Publication Data

US 2016/0125811 A1 May 5, 2016

(30) Foreign Application Priority Data

Oct. 31, 2014 (KR) ..... 10-2014-0149901

(51) Int. Cl.

| | |
|---|---|
| ***G09G 3/30*** | (2006.01) |
| ***G09G 3/3258*** | (2016.01) |
| ***G09G 3/00*** | (2006.01) |
| *G09G 3/10* | (2006.01) |
| *G09G 3/3291* | (2016.01) |

(52) U.S. Cl.

CPC ..... *G09G 3/3258* (2013.01); *G09G 3/006* (2013.01); *G09G 3/3291* (2013.01); *G09G 2300/0452* (2013.01); *G09G 2300/0809* (2013.01); *G09G 2310/08* (2013.01); *G09G 2320/0233* (2013.01); *G09G 2320/0238* (2013.01); *G09G 2320/0285* (2013.01); *G09G 2320/045* (2013.01); *G09G 2320/0626* (2013.01); *G09G 2330/10* (2013.01); *G09G 2330/12* (2013.01)

(58) Field of Classification Search

CPC ..... G09G 3/325; G09G 3/3258; G09G 3/006; G09G 3/3291

USPC ..... 345/76; 315/169.3

See application file for complete search history.

(56) References Cited

U.S. PATENT DOCUMENTS 8,599,191 B2 * 12/2013 Chaja ..... G09G 3/3233 345/212
8,816,946 B2 * 8/2014 Nathan ..... G09G 3/3233 315/169.3

(Continued)

FOREIGN PATENT DOCUMENTS

CN 1983365 A 6/2007
CN 100545897 C 9/2009

(Continued)

*Primary Examiner* — Adam J Snyder
(74) *Attorney, Agent, or Firm* — Dentons US LLP

(57) ABSTRACT

Disclosed is an OLED display device capable of sensing and correcting a progressive bright point defect and a method of driving the same. The OLED display device includes a data driver for supplying an off-driving voltage to a driving transistor for driving a light emitting element in each sub-pixel, and sensing a voltage corresponding to a leakage current of the driving transistor, and a bright point estimator for estimating a progressive bright point of a sub-pixel by comparing a voltage value sensed through the data driver with a reference value, and darkening and correcting the sub-pixel estimated to have the progressive bright point.

10 Claims, 11 Drawing Sheets

(56) References Cited

U.S. PATENT DOCUMENTS

| | | | | |
|---|---|---|---|---|
| 8,922,544 | B2 * | 12/2014 | Chaji | G09G 3/3233 345/20 |
| 9,171,500 | B2 * | 10/2015 | Chaji | G09G 3/3233 |
| 9,171,504 | B2 * | 10/2015 | Azizi | G09G 3/3233 |
| 9,530,349 | B2 * | 12/2016 | Chaji | G09G 3/3233 |
| 2007/0159742 | A1 | 7/2007 | Iwabuchi et al. | |
| 2008/0084365 | A1 | 4/2008 | Takahara et al. | |
| 2009/0213046 | A1 * | 8/2009 | Nam | G09G 3/3233 345/76 |
| 2013/0050292 | A1 | 2/2013 | Mizukoshi | |
| 2013/0099692 | A1 * | 4/2013 | Chaji | G09G 3/3233 315/224 |
| 2014/0340432 | A1 * | 11/2014 | Chaji | G09G 3/3233 345/690 |

FOREIGN PATENT DOCUMENTS

| | | | |
|---|---|---|---|
| CN | 101661169 | A | 3/2010 |
| CN | 102968954 | A | 3/2013 |
| CN | 103165056 | A | 6/2013 |

* cited by examiner

ORGANIC LIGHT EMITTING DIODE DISPLAY DEVICE CAPABLE OF SENSING AND CORRECTING A PROGRESSIVE BRIGHT POINT DEFECT

This application claims the benefit of Korean Patent Application No. 10-2014-0149901, filed on Oct. 31, 2014, which is hereby incorporated by reference for all purposes as if fully set forth herein.

BACKGROUND OF THE INVENTION

Field of the Invention

The present invention relates to an organic light emitting diode (OLED) display device. More particular, the present invention relates to an OLED display device capable of sensing and correcting a progressive bright point defect, and a method of driving the same.

Discussion of the Related Art

A liquid crystal display (LCD) using a liquid crystal, an organic light emitting diode (OLED) display device using an OLED, an electrophoretic display (EPD) using electrophoretic particles, etc. have been generally used as a flat panel display device that displays an image using digital data.

Among the above-mentioned devices, the OLED display device is a self-emissive device that allows an organic light emitting layer to emit light through recombination of an electron and a positive hole. The OLED display device has a high luminance and a low driving voltage and may be configured as an ultra-thin film. Thus, the OLED display device is expected to be used as a next generation display device.

Each of a plurality of pixels or sub-pixels included in the OLED display device has an OLED element that includes an organic light emitting layer between an anode and a cathode and a pixel circuit that independently drives the OLED element.

The pixel circuit includes a switching thin film transistor (TFT) that supplies a data voltage such that a storage capacitor is charged with a voltage corresponding to the data voltage, a driving TFT that controls a current based on the voltage with which the storage capacitor is charged and supplies the current to the OLED element, etc. The OLED element generates light in proportion to the current. The current supplied to the OLED element is affected by driving characteristics such as threshold voltage (Vth), mobility, etc. of the driving TFT.

However, the threshold voltage, the mobility, etc. of the driving TFT differ between sub-pixels for various reasons. For example, an initial threshold voltage, a mobility, etc. of the driving TFT differ between sub-pixels due to process variation, etc., and a difference occurs between sub-pixels due to deterioration of the driving TFT, etc. that occurs as a driving time passes. As a result, currents of the respective sub-pixels are non-uniform for the same data, and thus a problem of non-uniform luminance occurs. To solve this problem, the OLED display device uses an external compensation method of compensating for data by sensing the driving characteristics of the driving TFT.

For example, the external compensation method senses a voltage (or a current) indicating a driving characteristic of each driving TFT, computes compensation values for compensating for variations of a threshold voltage and a mobility of the driving TFT based on the sensed value to store the compensation values in a memory or update values, and then compensates for data to be supplied to each sub-pixel using the stored compensation values.

The OLED display device has a problem of a minute short-circuit defect due to particles, etc. that enter during a manufacturing process. The minute short-circuit defect is not detected in an inspection process, etc. prior to product shipping. However, when a driving time passes after product shipping, a resistance component due to the particles gradually decreases. In this way, short-circuit is generated, which leads to a progressive bright point defect.

Therefore, while a short-circuit defect detected in the inspection process may be corrected to be darkened by being repaired, the progressive bright point defect, which is not detected in the inspection process and found with the lapse of a driving time due to the minute short-circuit defect, may neither be detected nor corrected.

SUMMARY OF THE INVENTION

Accordingly, the present invention has been conceived to solve the above-described problem, and a subject to be solved by the present invention relates to an organic light emitting diode (OLED) display device capable of sensing and correcting a progressive bright point defect and a method of driving the same.

To solve the above subject, an OLED display device according to an embodiment of the present invention includes a data driver for supplying an off-driving voltage to a driving transistor for driving a light emitting element in each sub-pixel, and sensing a voltage corresponding to a leakage current of the driving transistor, and a bright point estimator for estimating a progressive bright point of a sub-pixel by comparing a voltage value sensed through the data driver with a reference value, and darkening and correcting the sub-pixel estimated to have the progressive bright point.

The data driver may supply a black data voltage and a reference voltage to first and second nodes, respectively, of the driving transistor of the sub-pixel to supply a difference voltage of the black data voltage and the reference voltage as the off-driving voltage to the driving transistor.

The data driver may store the leakage current in a capacitor connected to a reference line after the leakage current according to the off-driving voltage of the driving transistor flows to the light emitting element during a predetermined light emission period to sense a voltage stored in the capacitor.

The bright point estimator may compare the sensed voltage value with the black data, estimates the sub-pixel to have the progressive bright point when the sensed voltage value is greater than or equal to the black data, allows the black data to be supplied to the sub-pixel estimated to have the progressive bright point, and darkens the sub-pixel by increasing the reference voltage according to the sensed voltage value.

An image processor including the bright point estimator may sense a threshold voltage of the driving transistor through the data driver, compare the sensed threshold voltage with a predetermined minimum threshold voltage to sense a normal bright point in which the sensed threshold voltage is less than the minimum threshold voltage, and darken the sub-pixel sensed to have the normal bright point by supplying black data to the sub-pixel.

The bright point estimator may estimate and sense a sub-pixel expected to have the progressive bright point as a driving time passes due to a minute short-circuit resulting from particles between a supply line of a high-potential voltage and a gate node of the driving transistor.

A method of driving an OLED display device according to an embodiment of the present invention includes sensing a voltage corresponding to a leakage current according to an off-driving voltage of a driving transistor for driving a light emitting element in each sub-pixel, estimating a progressive bright point of a sub-pixel by comparing the sensed voltage with a reference value, and darkening and correcting the sub-pixel expected to have the progressive bright point.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Prior to a description of a preferred embodiment of the present invention, a cause of a progressive bright point defect due to a minute short-circuit will be examined.

Figure 1:
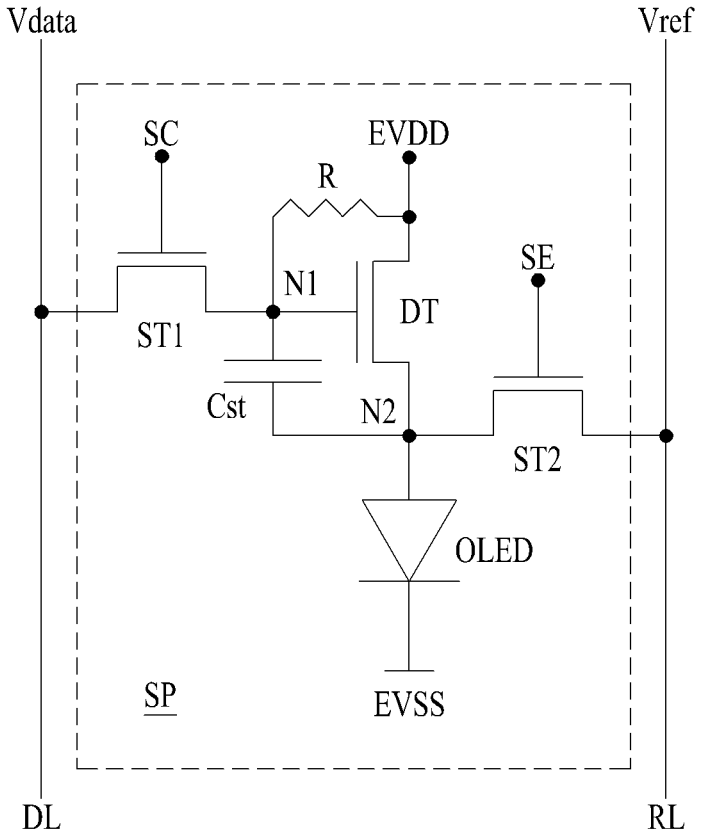
FIG. 1 is an equivalent circuit diagram illustrating an example of a sub-pixel having a progressive bright point defect in an OLED display device according to the present invention.
Figure 2:
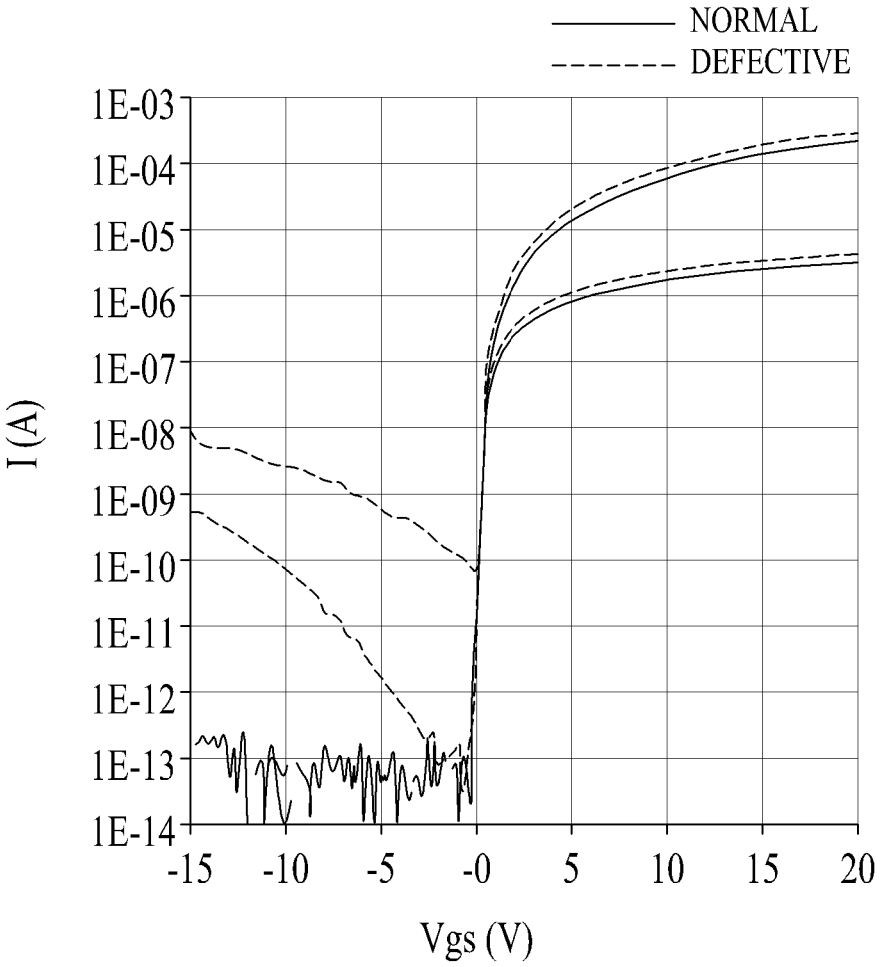
FIG. 2 is a graph illustrating a change characteristic of voltage versus current due to a minute short-circuit defect of a driving transistor illustrated in FIG. 1.

FIG. 1 is an equivalent circuit diagram illustrating an example of a sub-pixel expected to have a progressive bright point defect in an OLED display device according to the present invention, and FIG. 2 is a graph illustrating a change characteristic of a current with respect to a driving voltage of a driving transistor illustrated in FIG. 1.

A sub-pixel SP illustrated in FIG. 1 includes an OLED element and a pixel circuit that includes first and second switching transistors ST1 and ST2, a driving transistor DT, and a storage capacitor Cst to independently drive the OLED element.

The first switching transistor ST1 supplies a data voltage Vdata from a data line to a gate node N1 of the driving transistor DT according to a scan signal SC of one gate line.

The second switching transistor ST2 supplies a reference voltage Vref from a reference line RL to a source node N2 of the driving transistor DT according to a sensing control signal SE of another gate line. The second switching transistor ST2 is more frequently used as a path for outputting a current from the driving transistor DT to the reference line RL according to the sensing control signal SE in a sensing mode.

The storage capacitor Cst is charged with a difference voltage Vdata−Vref obtained by subtracting the reference voltage Vref supplied to the source node N2 through the second switching transistor ST2 from the data voltage Vdata supplied to the gate node N1 through the first switching transistor ST1 to supply the difference voltage as a driving voltage Vgs of the driving transistor DT.

The driving transistor DT controls a current supplied from a supply line of a high-potential voltage EVDD according to the driving voltage Vgs the storage capacitor Cst is charged with to supply a current Ids in proportion to the driving voltage Vgs to the OLED element, thereby allowing the OLED element to emit light.

Referring to FIG. 1, a minute short-circuit due to particles between the gate node N1 of the driving transistor DT and the supply line of the high-potential voltage EVDD is indicated by a resistance component R. Initially, the minute short-circuit due to the particles is not detected as a short-circuit defect in an inspection process, etc. since the resistance component R is great.

However, as the resistance component R of the minute short-circuit gradually decreases with the passage of a driving time, the gate node N1 of the driving transistor DT gradually increases by the high-potential voltage EVDD. Thus, as illustrated in FIG. 2, it can be understood that a leakage current is generated even when an off voltage (block data voltage) less than a threshold voltage is supplied as the driving voltage Vgs. When the OLED element emits light by the leakage current, a progressive bright point defect recognized as a bright point is generated.

To prevent the progressive bright point defect, the present invention proposes a scheme of estimating a progressive bright point due to the minute short-circuit defect by sensing the leakage current through long-term driving of the driving transistor DT, and darkening a sub-pixel estimated as the progressive bright point through voltage correction.

Figure 3:
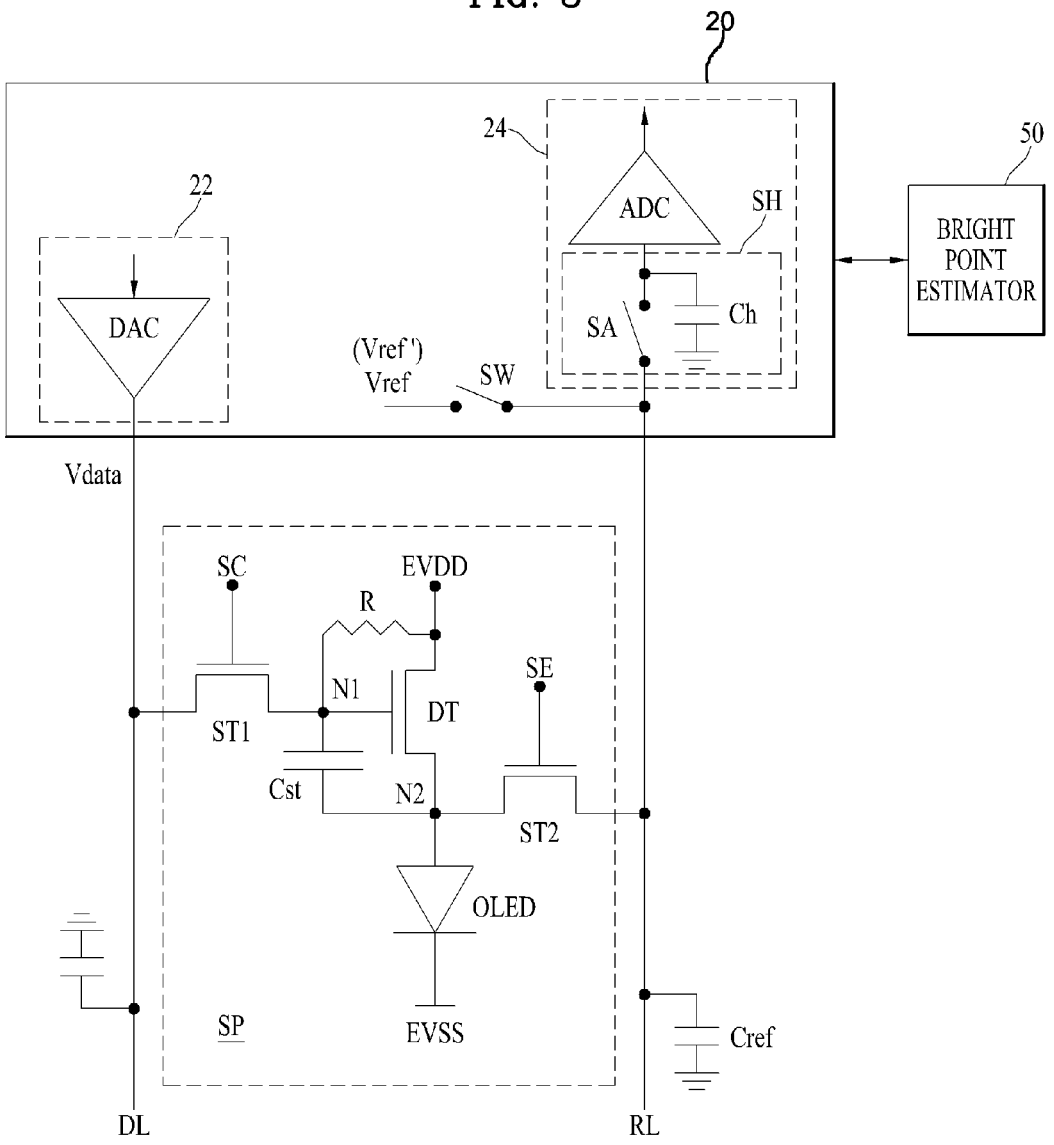
FIG. 3 is an equivalent circuit diagram illustrating a portion of an OLED display device capable of estimating, sensing, and correcting a progressive bright point according to an embodiment of the present invention.

FIG. 3 is an equivalent circuit diagram illustrating a portion of an OLED display device capable of estimating, sensing, and correcting a progressive bright point according to an embodiment of the present invention.

When compared to FIG. 1, FIG. 3 additionally illustrates a data driver 20 and a bright point estimator 50 connected to the data line DL and the reference line RL. Thus, description of components corresponding to duplicate elements between FIG. 1 and FIG. 3 will be omitted.

The data driver 20 supplies a black data voltage Vdata to each sub-pixel to sufficiently secure a light emitting time due to the leakage current of the driving transistor DT, and then senses and outputs a voltage corresponding to the leakage current of the driving transistor DT through the reference line RL.

The data driver 20 includes a data driving unit 22 that supplies the data voltage Vdata to the data line DL, a sensing unit 24 that senses a voltage corresponding to a current of the driving transistor DT through the reference line RL, and a switch SW that supplies the reference voltage Vref to the reference line RL.

The data driving unit 22 includes a digital-analog converter (hereinafter, referred to as a DAC) that converts input digital data into an analog data voltage Vdata and outputs the converted analog data voltage Vdata to the data line DL, etc.

The switch SW is turned ON only during a reference supply period (initialization period and light emission period) to supply the reference voltage Vref to the reference line RL.

The sensing unit 24 includes a sample and hold unit SH that samples and holds a voltage sensed through the reference line RL, an analog-digital converter (hereinafter, referred to as an ADC) that converts a sensing voltage from the SH into digital data and outputs the converted digital data to the bright point estimator 50, etc. The sample and hold unit SH includes a sampling switch SA and a capacitor Ch. The sampling switch SA samples a sensing voltage corresponding to the leakage current of the driving transistor DT through the reference line RL and stores the sensing voltage in the capacitor Ch, and the capacitor Ch supplies the stored sensing voltage to the ADC.

The bright point estimator 50 estimates whether a sub-pixel has a progressive bright point defect using a sensing value from the data driver 20 in a sensing mode, corrects the data voltage Vdata and the reference voltage Vref to be supplied to the sub-pixel such that a sub-pixel estimated to have the progressive bright point defect in a display mode is darkened, and supplies the corrected values to the data driver 20. A detailed description thereof will be provided below.

The OLED display device illustrated in FIG. 3 is in a leakage current sensing mode in which a leakage current of a sub-pixel is sensed as in FIGS. 4 and 5A-5D such that a progressive bright point due to a minute short-circuit is estimated.

Figure 4:
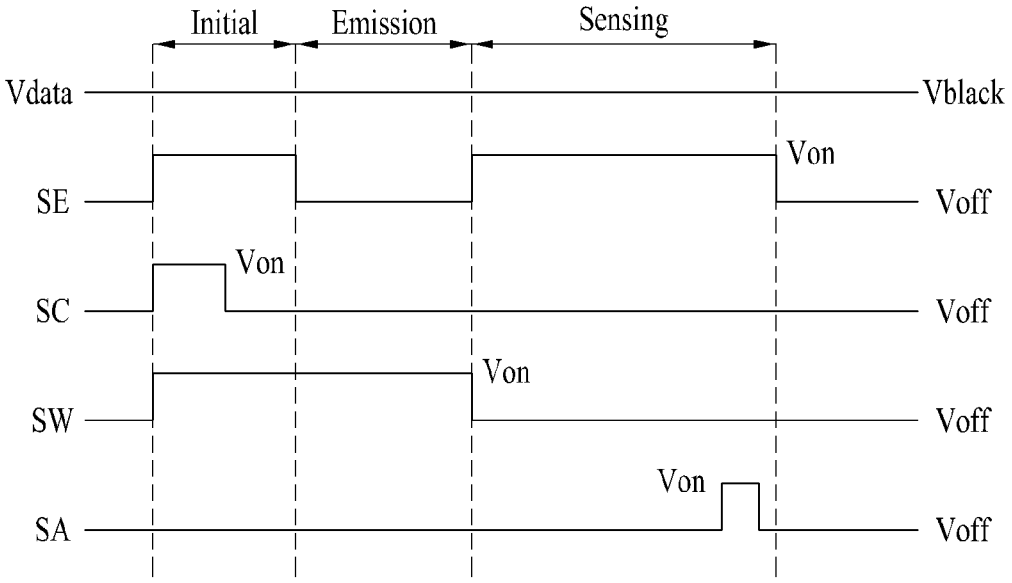
FIG. 4 is a diagram illustrating a driving waveform for sensing a leakage current in the OLED display device illustrated in FIG. 3.

FIG. 4 is a diagram illustrating a driving waveform of the OLED display device illustrated in FIG. 3 in the leakage current sensing mode, and FIGS. 5A to 5D are diagrams successively illustrating a leakage current sensing process of the sub-pixel illustrated in FIG. 3.

Figure 5A:
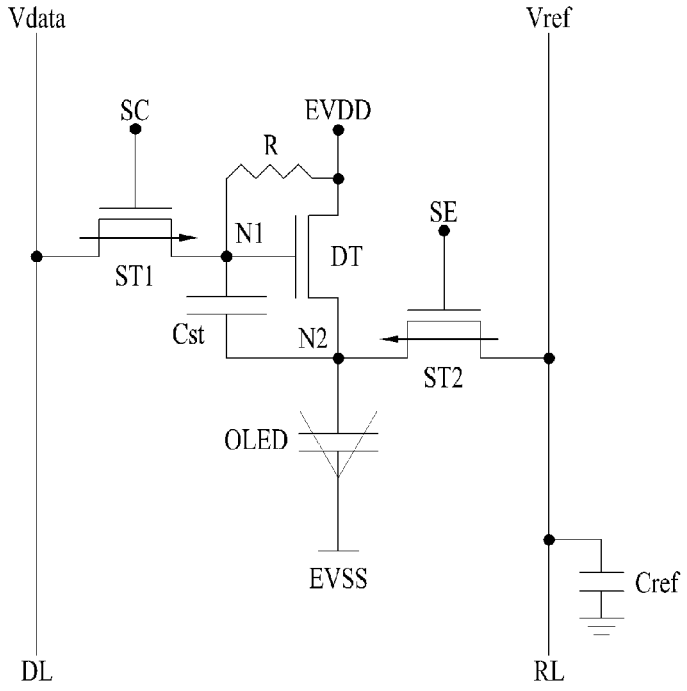
FIGS. 5A, 5B, 5C and 5D are diagrams successively illustrating a leakage current sensing process of a sub-pixel illustrated in FIG. 3.
Figure 5B:
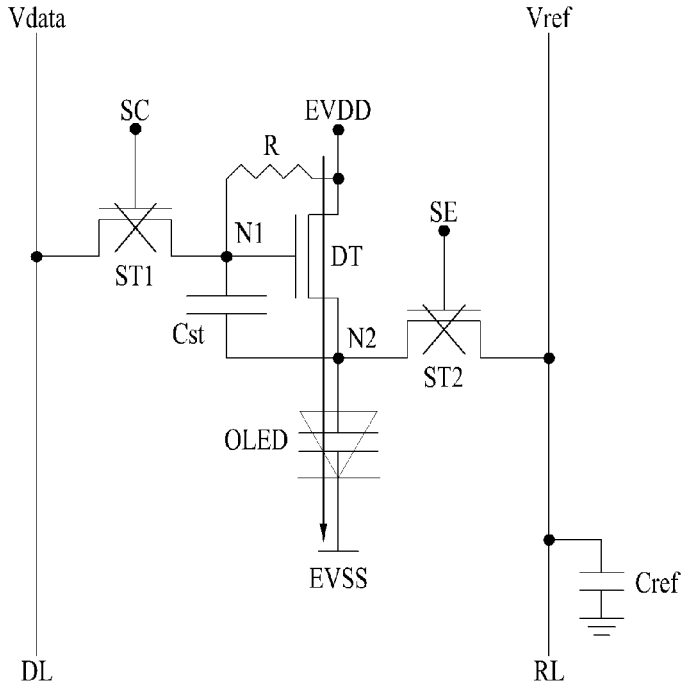
Figure 5C:
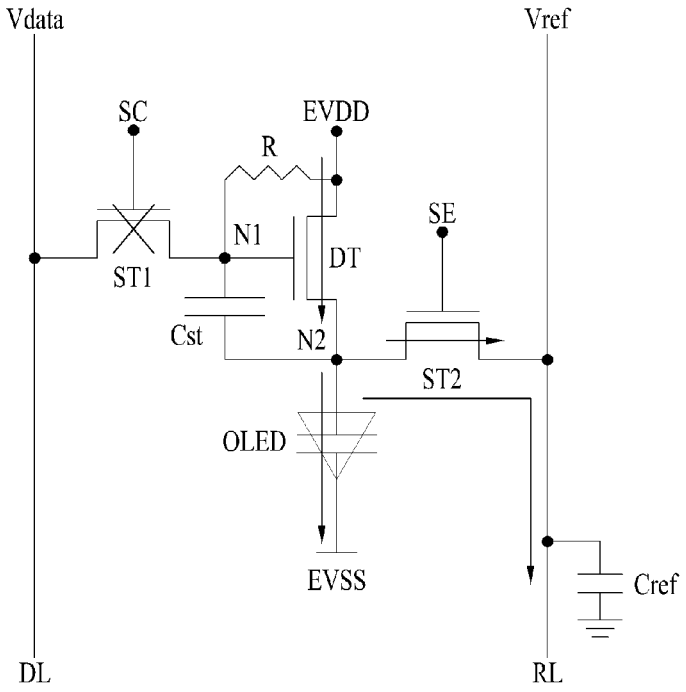
Figure 5D:
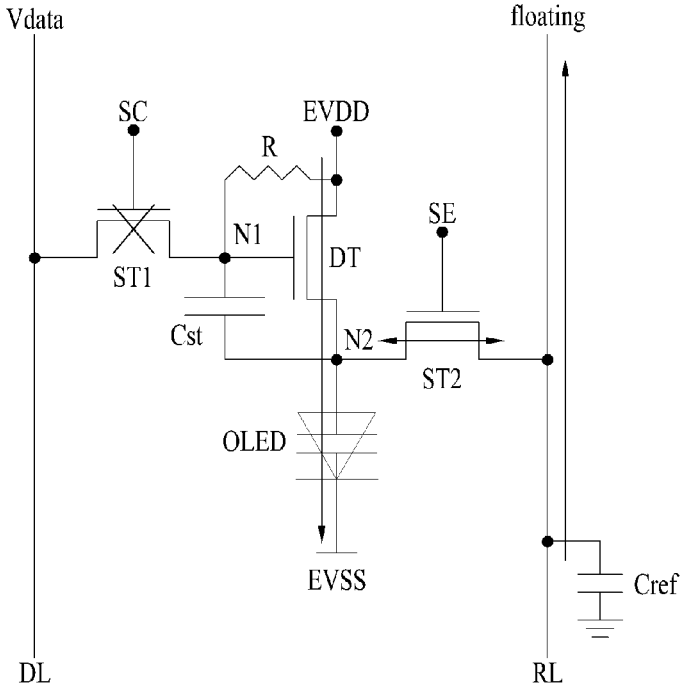

The leakage current sensing mode includes an initialization period (FIG. 5A), a light emission period (FIG. 5B), and a sensing period (FIGS. 5C and 5D).

Referring to FIGS. 4 and 5A, in the initialization period, the data driver 20 (FIG. 3) supplies a block data voltage Vblack to the data line DL, and supplies a reference voltage Vref corresponding to an initialization voltage to the reference line RL. The first switching transistor ST1 is turned ON in response to a gate-on voltage Von of the scan signal SC to supply the block data voltage Vblack to the gate node N1 of the driving transistor DT, and the second switching transistor ST2 is turned ON in response to a gate-on voltage Von of the sensing control signal SE to supply the reference voltage Vref to the source node N2 of the driving transistor DT. In this way, the storage capacitor Cst is charged with a difference voltage Vblack−Vref obtained by subtracting the reference voltage Vref from the black data voltage Vblack. The difference voltage Vblack−Vref is less than a threshold voltage Vth of the driving transistor DT. In the initialization period illustrated in FIG. 4, a period in which the second switching transistor ST2 is turned ON by the sensing control signal SE may be longer than a period in which the first switching transistor ST1 is turned ON by the scan signal SC.

Referring to FIGS. 4 and 5B, in the light emission period, the first switching transistor ST1 is turned OFF in response to a gate-off voltage Voff of the scan signal SC, the second switching transistor ST2 is turned OFF in response to a gate-off voltage Voff of the sensing control signal SE, and the reference line RL maintains the reference voltage Vref supplied from the data driver 20. The driving voltage Vgs (=Vblack−Vref) stored in the storage capacitor Cst is less than the threshold voltage Vth of the driving transistor DT. Thus, when the sub-pixel is in a normal state, the driving transistor DT is turned OFF, and the OLED element does not emit light. However, when the sub-pixel has a minute short-circuit defect due to particles between the supply line of the high-potential voltage EVDD and the gate node N1 of the driving transistor DT, the resistance component R of the minute short-circuit gradually decreases over time during the emission period. As a result, a voltage of the gate node N1 of the driving transistor DT increases due to the high-potential voltage EVDD, which leads to increase in the driving voltage Vgs of the driving transistor DT. In this way, the leakage current increases and thus the OLED element emit lights. The light emission period is set to a sufficiently long period which is longer than or equal to 50 msec in order to sense the leakage current due to the minute short-circuit.

Referring to FIGS. 4 and 5C, in the sensing period, the switch SW that supplies the reference voltage Vref from the data driver 20 (FIG. 3) is turned OFF in response to the gate-off voltage Voff, and the reference line RL floats. The second switching transistor ST2 is turned ON in response to the gate-on voltage Von of the sensing control signal SE to supply the leakage current of the driving transistor DT to the reference line RL. In this way, a parasitic capacitor Cref of the reference line RL is charged with a sensing voltage corresponding to the leakage current of the driving transistor DT, that is, a voltage of the source node N2 of the driving transistor DT.

Referring to FIGS. 4 and 5D, in the sampling period corresponding to a latter half of the sensing period, in response to the sampling switch SA of the data driver 20 illustrated in FIG. 3 being turned ON by the gate-on voltage Von, the SH samples and holds the sensing voltage stored in the reference line RL and supplies the stored sensing voltage to the ADC, and the ADC converts the sensing voltage into a digital sensing value and supplies the digital sensing value to the bright point estimator 50.

The bright point estimator 50 illustrated in FIG. 3 compares the sensing value from the data driver 20 with the black data value supplied to the data driver 20. The bright point estimator 50 estimates the sub-pixel to have a progressive bright point defect when the sensing value is greater than or equal to the black data value, and estimates the sub-pixel to be a normal sub-pixel when the sensing value is less than the black data value.

The bright point estimator 50 darkens the sub-pixel estimated to have the progressive bright point defect in the display mode by correcting data and a reference voltage Vref1 to be supplied to the sub-pixel.

Specifically, the bright point estimator 50 corrects data of the sub-pixel estimated to have the progressive bright point defect to black data and supplies the black data to the data driver 20 such that the data driver 20 allows the black data voltage Vblack to be supplied to the sub-pixel. Further, the bright point estimator 50 corrects the reference voltage Vref to be supplied to the sub-pixel estimated to have the progressive bright point defect to a high value such that a corrected reference voltage Vref' is supplied to the sub-pixel through the data driver 20. The bright point estimator 50 may increase the reference voltage Vref according to the sensing value.

In this way, in the display mode, a driving voltage Vgs (=Vblack−Vref'<Vth) less than the threshold voltage Vth is supplied to the driving transistor DT of the sub-pixel at all times. Thus, the driving transistor DT is turned OFF, thereby darkening the sub-pixel. In addition, even when a voltage of the gate node N1 of the driving transistor DT increases as the resistance component R of the minute short-circuit gradually decreases, the driving voltage Vgs (=Vblack−Vref'<Vth) less than the threshold voltage Vth is supplied to the driving transistor DT of the sub-pixel at all times due to the corrected reference voltage Vref', and thus the driving transistor DT is turned OFF. In this way, the sub-pixel maintains a darkened state.

Therefore, the OLED display device according to the present invention may estimate a progressive bright point resulting from a minute short-circuit defect by sensing a leakage current through a long-term driving of the driving transistor DT, and darken a sub-pixel estimated to have the progressive bright point, thereby preventing a progressive bright point defect.

FIGS. 6A, 6B, 7A, 7B, 8A and 8B are diagrams illustrating simulation results obtained by sensing a leakage current of a driving transistor DT in an OLED display device according to an embodiment of the present invention.

Figure 6A:
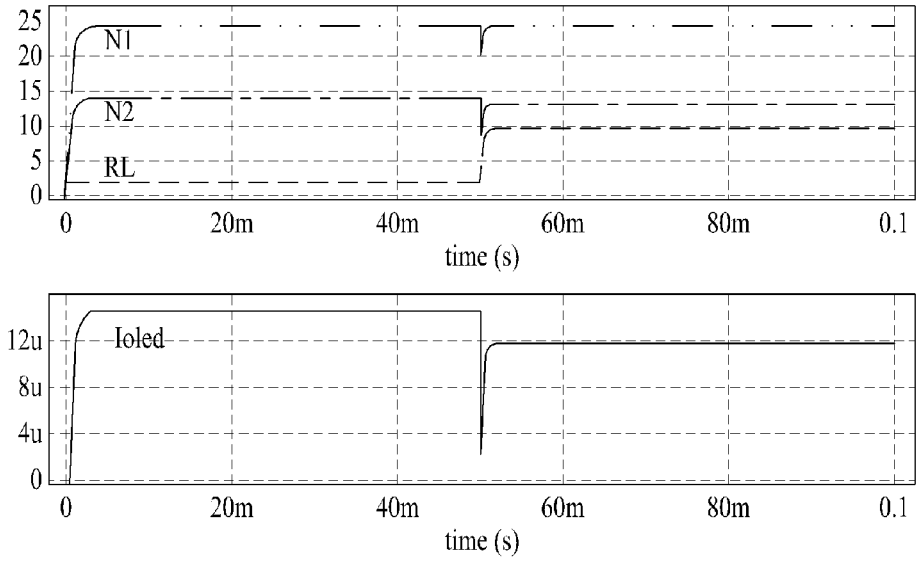
FIGS. 6A, 6B, 7A, 7B, 8A and 8B are diagrams illustrating simulation results obtained by sensing a leakage current according to a resistance value of a minute short-circuit of a driving transistor in an OLED display device according to an embodiment of the present invention.
Figure 6B:
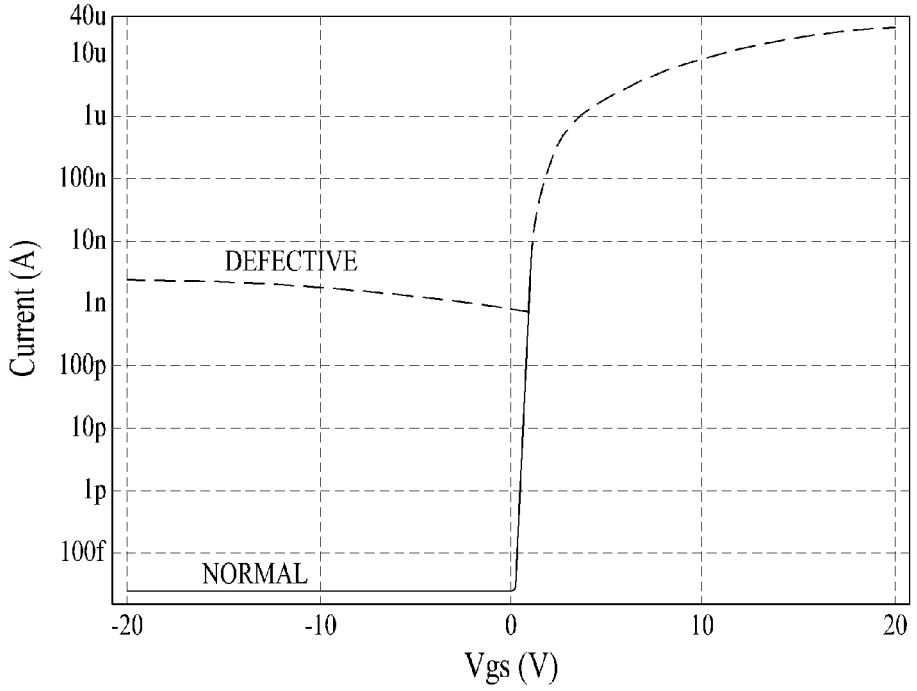

When a resistance R of the minute short-circuit illustrated in FIG. 3 is 10 G, FIG. 6A illustrates a result of sensing a voltage of the gate node N1 of the driving transistor DT, a voltage of the source node N2, a voltage of the reference line RL, and a current Ioled of the OLED element, and FIG. 6B illustrates a change characteristic of a current with respect to the driving voltage Vgs of the driving transistor DT.

Referring to FIG. 6A, it can be understood that, in a light emission period, the voltage of the gate node N1 of the driving transistor DT increases due to the component R of the minute short-circuit, and the voltage of the source node N2 and the OLED current Ioled increase due to the leakage current of the driving transistor DT resulting from increase in the voltage of the gate node N1, and thus the OLED element emits light in an abnormal manner. In addition, it can be understood that, in a sensing period after the light emission period, the voltage of the reference line RL increases according to the voltage of the source node N2 increased by the leakage current of the driving transistor DT. Therefore, it is possible to sense a voltage corresponding to the leakage current of the driving transistor DT through the reference line RL.

Referring to FIG. 6B, it can be understood that a sub-pixel having a minute short-circuit resistance R of 10 G due to particles has a progressive bright point defect since a leakage current of a driving transistor DT greatly increases beyond a permitted range in an off region in which a driving voltage Vgs is less than a threshold voltage.

Figure 7A:
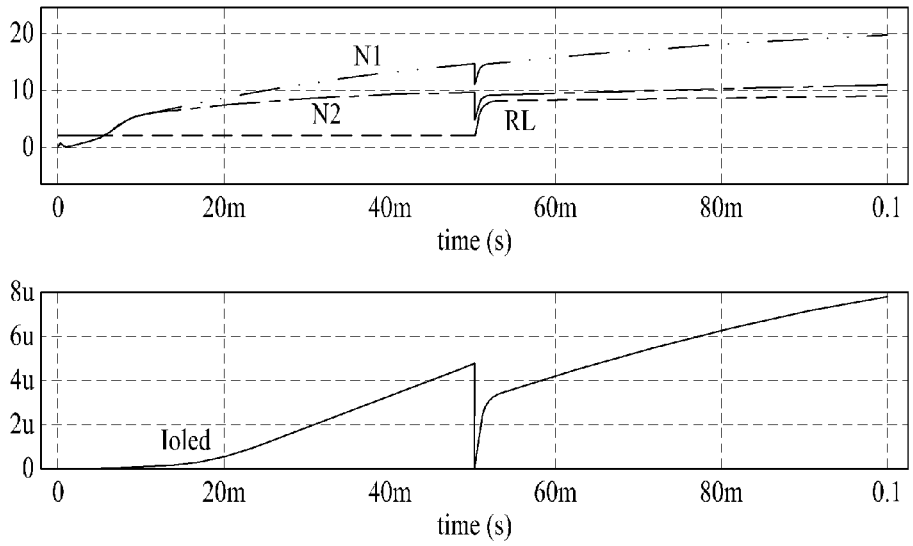
Figure 7B:
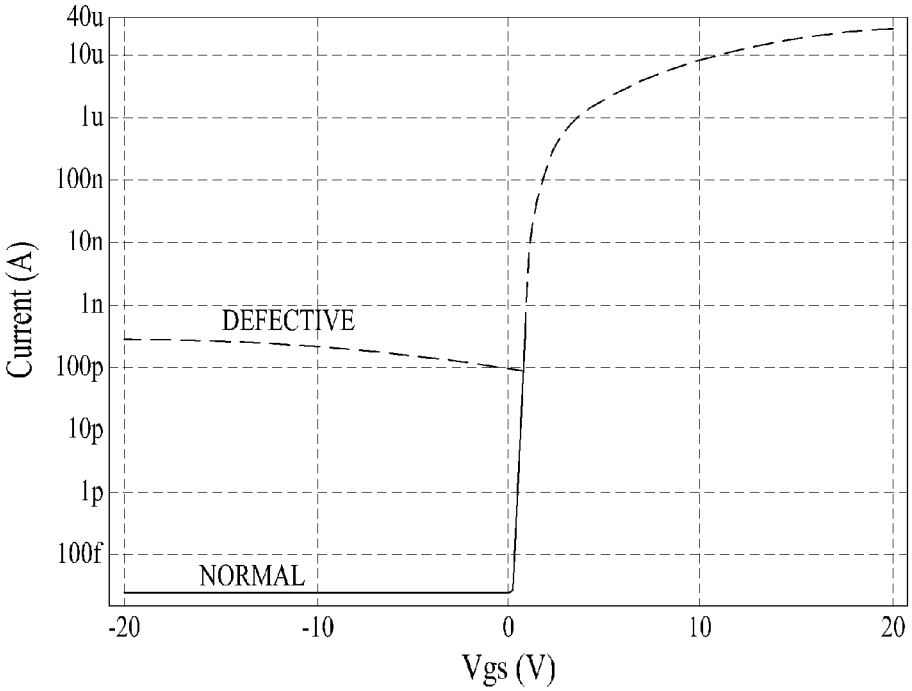

When a resistance R of the minute short-circuit illustrated in FIG. 3 is 100 G, which is ten times that of FIGS. 6A and 6B, FIG. 7A illustrates a result of sensing a voltage of the gate node N1 of the driving transistor DT, a voltage of the source node N2, a voltage of the reference line RL, and a current Ioled of the OLED element, and FIG. 7B illustrates a change characteristic of a current with respect to the driving voltage Vgs of the driving transistor DT.

Referring to FIG. 7A, it can be understood that, in a light emission period, the voltage of the gate node N1 of the driving transistor DT gradually increases due to the component R of the minute short-circuit, and the voltage of the source node N2 and the OLED current Ioled gradually increase due to the leakage current of the driving transistor DT resulting from the increase in the voltage of the gate node N1, and thus the OLED element emits light in an abnormal manner. In addition, it can be understood that, in a sensing period after the light emission period, the voltage of the reference line RL increases according to the voltage of the source node N2 increased by the leakage current of the driving transistor DT. Therefore, it is possible to sense a voltage corresponding to the leakage current of the driving transistor DT through the reference line RL.

Referring to FIG. 7B, it can be understood that a sub-pixel having a minute short-circuit resistance R of 100 G due to particles has a progressive bright point defect since a leakage current of a driving transistor DT greatly increases beyond a permitted range in an off region.

Figure 8A:
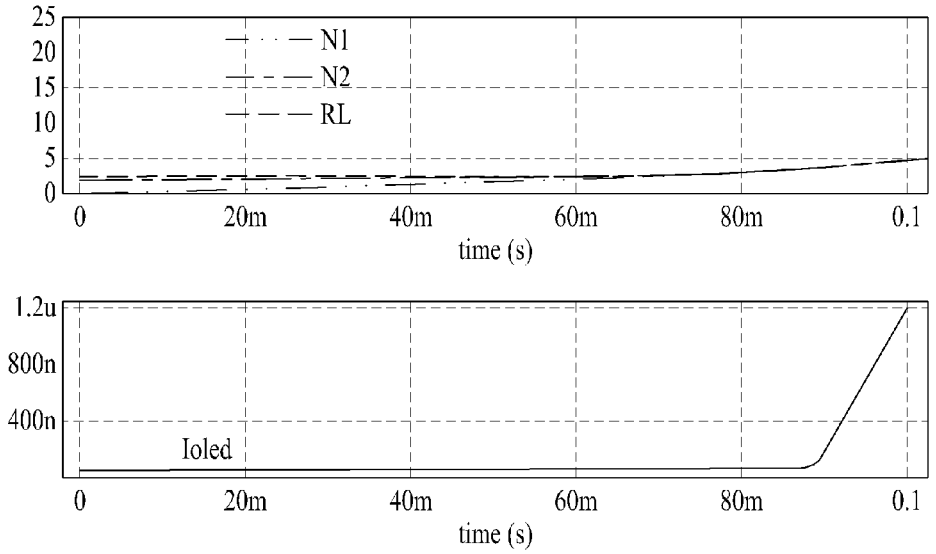
Figure 8B:
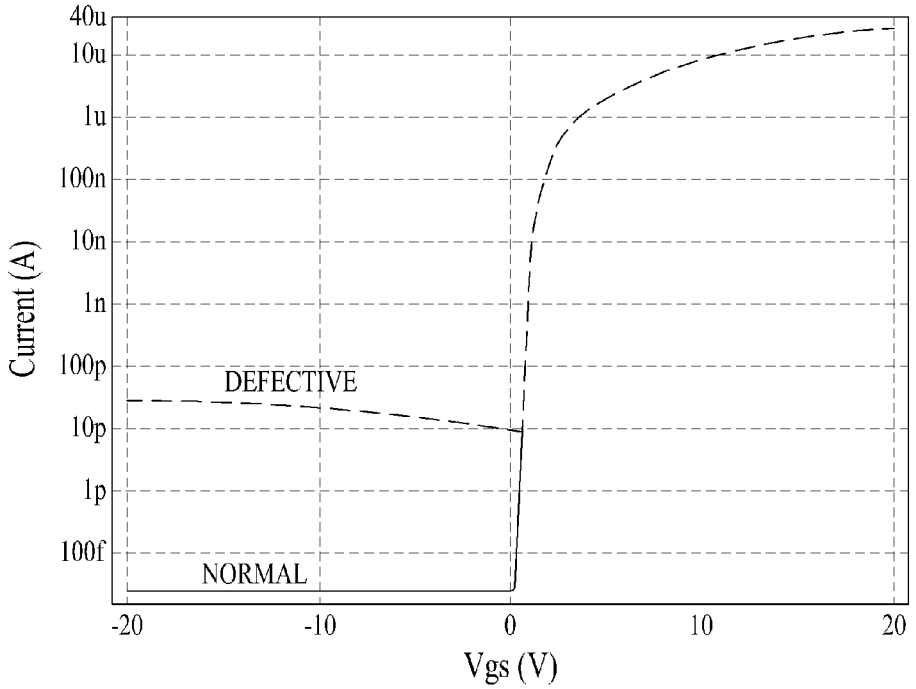

When a resistance R of the minute short-circuit illustrated in FIG. 3 is 1000 G, which is ten times that of FIGS. 7A and 7B, FIG. 8A illustrates a result of sensing a voltage of the gate node N1 of the driving transistor DT, a voltage of the source node N2, a voltage of the reference line RL, and a current Ioled of the OLED element, and FIG. 8B illustrates a change characteristic of a current with respect to the driving voltage Vgs of the driving transistor DT.

Referring to FIG. 8A, if the resistance component R is 1000 G, which is a large value, it can be understood that the voltage of the gate node N1 of the driving transistor DT, the voltage of the source node N2, the voltage of the reference line RL, and the OLED current Ioled do not significantly increase even when a driving time passes.

Referring to FIG. 8B, it can be understood that a sub-pixel having a great resistance R of 1000 G is in a normal state in which a leakage current in an off region of a driving transistor DT is within a permitted range.

Figure 9:
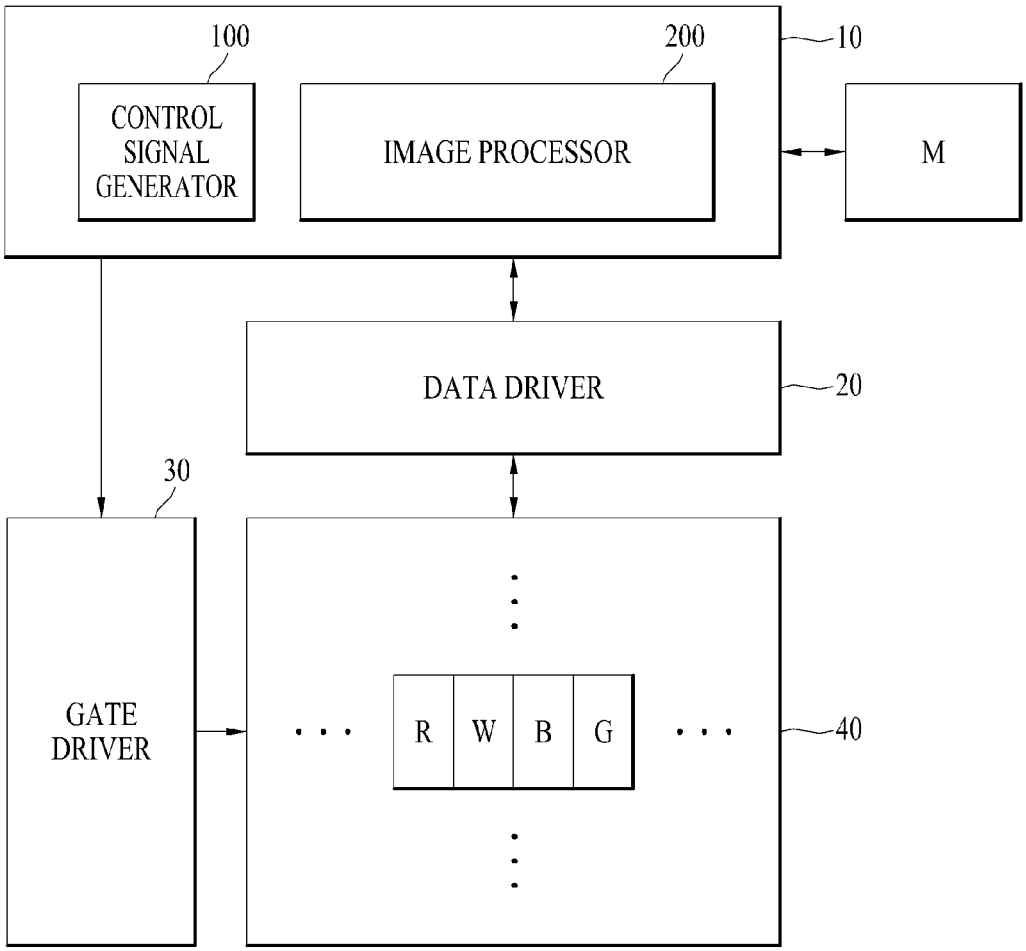
FIG. 9 is a block diagram schematically illustrating an OLED display device according to an embodiment of the present invention.

FIG. 9 schematically illustrates an OLED display device according to an embodiment of the present invention.

The OLED display device illustrated in FIG. 9 includes a timing controller 10 having a control signal generator 100 and an image processor 200, a memory M, a data driver 20, a gate driver 30, and a display panel 40. Here, the image processor 200 and the data driver 20 may be expressed as a data processor.

The image processor 200 may be incorporated in the timing controller 10 as illustrated in FIG. 9 and configured as one integrated circuit (IC), or configured as a separate IC by being separated from the timing controller 10 although not illustrated. In this case, the timing controller 10 may be connected between the image processor 200 and the data driver 20. Hereinafter, a description will be given of a case in which the timing controller 10 includes the image processor 200 as an example.

The memory M stores compensation information configured according to a characteristic of each sub-pixel for a uniform current of each sub-pixel. The compensation information includes a threshold voltage compensation value for compensating for a threshold voltage Vth of a driving transistor DT of each sub-pixel and a mobility compensation value for compensating for a mobility variation of a driving transistor DT. The compensation information is configured in advance based on a sensing value which is obtained by sensing a threshold voltage and a mobility corresponding to driving characteristics of each sub-pixel before product shipping and stored in the memory M. After product shipping, the compensation information stored in the memory M is updated by sensing a characteristic of each sub-pixel again through a sensing mode in each desired driving time. The compensation information stored in the memory M may be updated by executing the sensing mode in each desired time corresponding to at least one of a boot time when power is turned ON, an ending time when power is turned OFF, a blanking period of each frame, etc.

For example, mobility is greatly affected by temperature, light, etc. which are external environment conditions, and thus may be sensed in each period corresponding to at least one of the boot time when power is turned ON and the blanking period of each frame such that the mobility compensation value stored in the memory M may be updated. The threshold voltage may be sensed in each period corresponding to at least one of the blanking period of each frame and ending time when power is turned OFF such that the threshold voltage compensation value stored in the memory M may be updated.

In the timing controller 10, the control signal generator 100 generates a data control signal and a gate control signal that control driving time of the data driver 20 and the gate driver 30 using a plurality of timing signals input to an external system (not illustrated), and outputs the generated signals to the data driver 20 and the gate driver 30. For example, the control signal generator 100 generates and outputs a plurality of data control signals including a source start pulse, a source shift clock, a source output enable signal, etc. that control driving timing of the data driver 20 and a plurality of gate control signals including a gate start pulse, a gate shift clock, etc. that control driving timing of the gate driver 30 using a plurality of timing signals such as a clock signal, a data enable signal, a horizontal synchronization signal, a vertical synchronization signal, etc. from the external system.

In the timing controller 10, the image processor 200 compensates for image data input from the external system using the compensation information of the memory M, and outputs the compensated data to the data driver 20. The image processor 200 processes sensing information of each sub-pixel sensed through the data driver 20 according to a predetermined operation to convert the sensing information into compensation information, and updates the compensation information of the memory M.

In addition, the image processor 200 determines a peak luminance according to an image of each frame using input image data and calculates a total current. In addition, the image processor 200 determines a high-potential voltage according to the peak luminance and the total current and supplies the determined high-potential voltage to the data driver 20. In this way, power consumption is reduced.

In addition, in response to R/G/B data being input as image data from the external system, the image processor 200 may convert the R/G/B data into R'/G'/B'/W data through a predetermined operation and use the converted data for the above-described image processing. For example, the image processor 200 may generate a minimum gray level (or a common gray level) of the R/G/B data as W data according to a predetermined operation, and generates remaining R'/G'/B' data by subtracting each of the W data and the R/G/B data.

In addition, the image processor 200 may compare a threshold voltage of a driving transistor DT sensed from each sub-pixel in a desired sensing mode with a minimum threshold voltage to sense a normal bright point defect in which the sensed threshold value is less than the minimum threshold voltage, and darken a sub-pixel sensed to have the normal bright point defect by supplying block data in the display mode.

In particular, the image processor 200 may include the bright point estimator 50 illustrated in FIG. 3 to estimate a progressive bright point due to a minute short-circuit by sensing a leakage current of a driving transistor DT of each sub-pixel in a desired sensing mode, and darken a sub-pixel estimated as the progressive bright point by supplying black data and correcting a reference voltage in a display mode, thereby preventing a progressive bright point defect.

For example, normal bright point defect sensing and progressive bright point defect estimation and sensing of the image processor 200 may be executed in a sensing mode of a power-off state in which a threshold voltage of each driving transistor DT is sensed and updated. However, the present invention is not limited thereto.

The data driver 20 converts data supplied from the timing controller 10 into an analog data signal and supplies the converted signal to the display panel 40 using a data control signal supplied from the timing controller 10 in the display mode and the sensing mode. The data driver 20 converts digital data into an analog data voltage using a gamma voltage set from an integrated gamma voltage generator (not illustrated).

In addition, the data driver 20 converts a digital high-potential voltage supplied from a current controller 210 of the timing controller 10 into an analog high-potential voltage in the display mode and the sensing mode. Alternatively, the data driver 20 adjusts an analog high-potential voltage according to a digital high-potential voltage. Then, the data driver 20 supplies the voltage to the display panel 40. The gamma voltage generator divides the analog high-potential voltage through a resistor string to generate a gamma voltage set including a plurality of gamma voltages.

In addition, the data driver 20 converts a voltage (or a current) sensed through a reference line RL from each sub-pixel of the display panel 40 in the sensing mode into a digital sensing value and supplies the converted value to the timing controller 10.

The data driver 20 is configured as one data drive IC and mounted on a circuit film such as a tape carrier package (TCP), a chip on film (COF), a flexible print circuit (FPC), etc. The data driver 20 may be attached to the display panel 40 using tape automated bonding (TAB) or mounted on a non-display region of the display panel 40 using a chip on glass (COG) scheme.

The gate driver 30 drives a plurality of gate lines of the display panel 40 using a gate control signal supplied from the timing controller 10. The gate driver 30 supplies a scan pulse of a gate-on voltage to each gate line in a scan period and supplies a gate-off voltage in a remaining period using the gate control signal. The gate control signal may be supplied to the gate driver 30 directly from the timing controller 10 or from the timing controller 10 via the data driver 20.

The gate driver 30 may be configured as at least one gate drive ID. The gate driver 30 may be mounted on a circuit film such as a TCP, a COF, an FPC, etc. and attached to the display panel 40 using TAB. Alternatively, the gate driver 30 may be mounted on a non-display region of the display panel 40 using the COG scheme. On the other hand, the gate driver 30 may be formed on a non-display region of a TFT substrate together with a TFT array which is formed in a pixel array, thereby being formed as a gate in panel (GIP) in which the gate driver 30 is incorporated in the display panel 40.

The display panel 40 includes a pixel array in a matrix form. Each pixel of the pixel array includes R/W/B/G sub-pixels. Alternatively, each pixel may include R/G/B sub-pixels.

Figure 10:
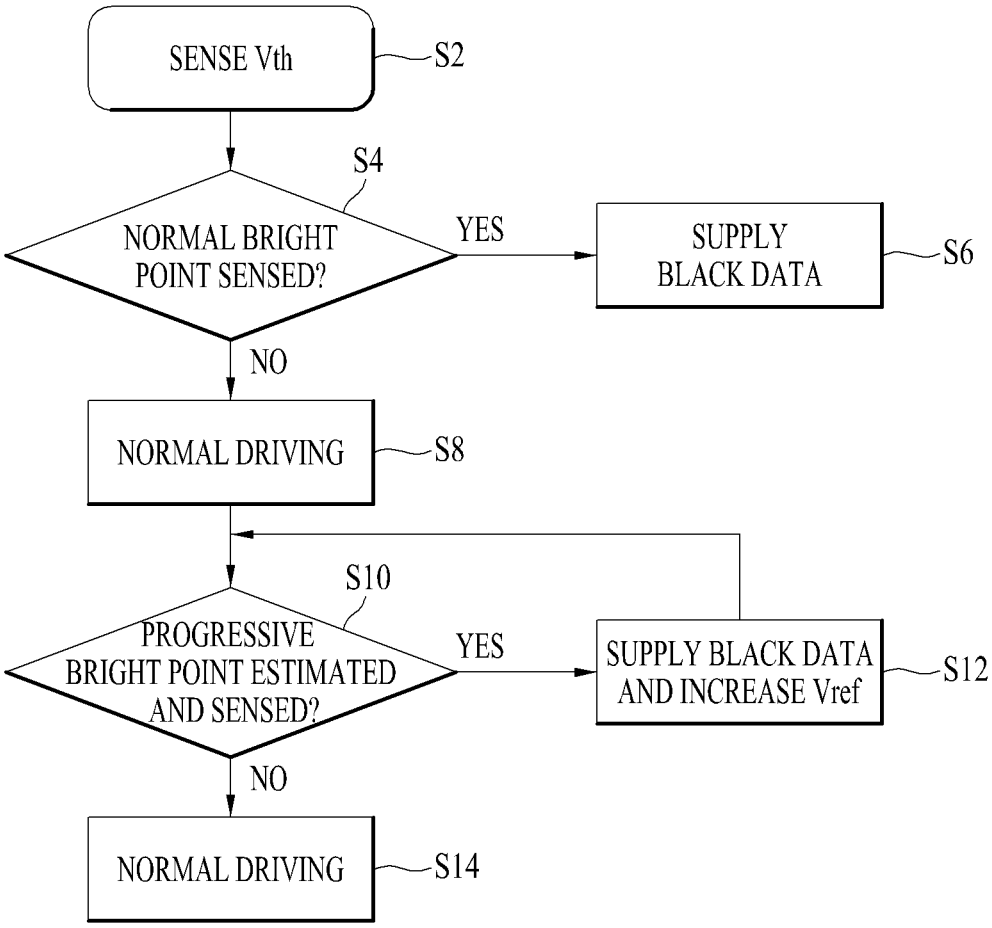
FIG. 10 is a flowchart illustrating, in stages, a method of estimating, sensing, and correcting a progressive bright point of an OLED display device according to an embodiment of the present invention.

FIG. 10 is a flowchart illustrating, in stages, a method of estimating, sensing, and correcting a progressive bright point of an OLED display device according to an embodiment of the present invention.

In step S2, the data driver 20 converts data for sensing supplied from the image processor 200 into an analog signal and supplies the converted signal to each sub-pixel of the display panel 40, and the image processor 200 senses a threshold voltage Vth of each sub-pixel through the data driver 20.

In step S4, the image processor 200 senses a normal bright point defect by comparing the sensed threshold voltage Vth of each sub-pixel with a predetermined minimum threshold voltage. The image processor 200 determines a sub-pixel to have the normal bright point defect when a sensed threshold voltage Vth thereof is less than the minimum threshold voltage, and proceeds to step S6 to darken the sub-pixel by supplying black data to the sub-pixel.

The image processor 200 determines a sub-pixel to be normal when a sensed threshold voltage Vth thereof is greater than or equal to the minimum threshold voltage, and proceeds to step S8 to normally drive normal sub-pixels.

In step S10, the data driver 20 converts the black data supplied from the image processor 200 into a black data voltage, supplies the converted voltage to each sub-pixel of the display panel 40, and senses a voltage corresponding to a leakage current of a driving transistor DT through a reference line RL after a sufficient light emission period. The image processor 200 estimates whether a progressive bright point defect is included by comparing the sensed value from the data driver 20 with the black data. When the sensed value is greater than or equal to the black data, the image processor 200 determines that the progressive bright point defect is included and proceeds to step S12 to supply the black data to the sub-pixel and darkens the sub-pixel by increasing a reference voltage Vref according to the sensed value. As the sensed value increases, the reference voltage Vref increases. Therefore, even when a minute short-circuit is generated in the driving transistor DT, a driving voltage Vgs of the driving transistor DT is less than the threshold voltage Vth, and thus the sub-pixel is darkened.

When the sensed value is less than the black data, the image processor 200 determines that the sub-pixel is normal and proceeds to step S14 to normally drive normal sub-pixels.

As described in the foregoing, an OLED display device and a method of driving the same according to the present invention may estimate and sense a sub-pixel expected to have a progressive bright point defect as a driving time passes due to a minute short-circuit by sensing a leakage current of a driving transistor DT for black data.

In addition, an OLED display device and a method of driving the same according to the present invention may darken a sub-pixel sensed and estimated to have a progressive bright point defect by correcting a gate-source voltage Vgs of a driving transistor DT to be less than a threshold voltage Vth using a black data voltage and a relatively high reference voltage.

In this way, an OLED display device and a method of driving the same according to the present invention may enhance image quality and increase lifespan by estimating and sensing a progressive bright point defect to correct the defect.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. An organic light emitting diode (OLED) display device comprising:

a panel including the plurality of sub-pixels, each sub-pixel at least including a light emitting element and a driving transistor driving the light emitting element;

a data driver configured to supply an off voltage to the driving transistor, sense a voltage corresponding to a leakage current according to the off voltage of the driving transistor of each sub-pixel, and convert the sensed voltage to a sensing value to output the sensing value; and a bright point estimator configured to compare the sensing value with a predetermined value, determine whether a corresponding sub-pixel is estimated as a progressive bright point defect according to the compared result, and allow a darkening voltage to be supplied to the corresponding sub-pixel determined as the progressive bright point defect to darken the corresponding sub-pixel at a display mode, wherein the progressive bright point defect is a normal sub-pixel at a current driving time but is a sub-pixel to be expected as a bright point defect with the lapse of a driving time of the panel.

2. The OLED display device according to claim 1, wherein the data driver supplies a black data voltage and a reference voltage to first and second nodes, respectively, of the driving transistor of the sub-pixel to supply a difference voltage of the black data voltage and the reference voltage as the off voltage to the driving transistor, and stores the leakage current of the driving transistor in a capacitor connected to a reference line after the leakage current according to the off-driving voltage of the driving transistor flows to the light emitting element during a predetermined period to sense a voltage stored in the capacitor.

3. The OLED display device according to claim 2, wherein the bright point estimator determines that the corresponding sub-pixel is the progressive bright point defect when the sensing value is greater than or equal to black data as the predetermined value, and allows the black data voltage to be supplied to the corresponding sub-pixel via the data driver, and increase the reference voltage according the sensing value to darken the corresponding sub-pixel at the display mode.

4. The OLED display device according to claim 3, further comprising an image processor including the bright point estimator, wherein the image processor further senses a threshold voltage of the driving transistor through the data driver, compares the sensed threshold voltage with a predetermined minimum threshold voltage to detect the bright point defect in which the sensed threshold voltage is less than the minimum threshold voltage, and darkens the sub-pixel detected as the bright point defect by supplying black data to the sub-pixel.

5. The OLED display device according to claim 4, wherein the progressive bright point defect is found as a driving time passes due to a minute short-circuit resulting from particles between a supply line of a high-potential voltage and a gate node of the driving transistor.

6. A method of driving an OLED display device, including the plurality of sub-pixels, each sub-pixel at least including a light emitting element and a driving transistor driving the light emitting element, comprising:

supplying an off voltage to the driving transistor of each sub-pixel;

sensing a voltage corresponding to a leakage current according to the voltage of hail the driving transistor and converting the sensed voltage to a sensing value;

comparing the sensing value with a predetermined value to determine whether a corresponding sub-pixel is estimated as a progressive bright point defect according to the compared result, wherein the progressive bright point defect is a normal sub-pixel at a current driving time but is a sub-pixel to be expected as a bright point defect with the lapse of a driving time of the panel; and supplying a darkening voltage to the corresponding sub-pixel determined as the progressive bright point to darken the corresponding sub-pixel at a display mode.

7. The method according to claim 6, wherein the sensing comprises:

supplying a black data voltage and a reference voltage to first and second nodes, respectively, of the driving transistor of the sub-pixel to supply a difference voltage of the black data voltage and the reference voltage as the off voltage to the driving transistor;

allowing the leakage current according to the off voltage of the driving transistor to flow to the light emitting element during a predetermined period; and storing the leakage current of the driving transistor in a capacitor connected to a reference line to sense a voltage stored in the capacitor.

8. The method according to claim 7, wherein when sensing value is greater than or equal to black data as the predetermined value, the corresponding sub-pixel is determined as the progressive bright point defect.

9. The method according to claim 7, wherein the darkening the corresponding sub-pixel comprises supplying the black data voltage to the corresponding sub-pixel determined as the progressive bright point, and adjusting the reference voltage according to the sensing value.

10. The method according to claim 9, further comprising, before supplying the off voltage:

sensing a threshold voltage of each driving transistor;

comparing the sensed threshold voltage with a predetermined minimum threshold voltage to detect the bright point defect in which the sensed threshold voltage is less than the minimum threshold voltage; and darkening a sub-pixel detected as the bright point defect by supplying the black data voltage to the sub-pixel.

* * * * *